United States Patent [19]

Ohtsuki et al.

[11] Patent Number: 4,671,594

[45] Date of Patent: Jun. 9, 1987

[54] CONNECTOR HAVING LOCK MEANS

[75] Inventors: Tomonari Ohtsuki; Kanzaburo Uchida, both of Mooka, Japan

[73] Assignee: Daiichi Denshi Kogyo Kabushiki Kaisha, Japan

[21] Appl. No.: 837,421

[22] Filed: Mar. 7, 1986

[30] Foreign Application Priority Data

Mar. 12, 1985 [JP] Japan ..... 60-34170

[51] Int. Cl.[4] ..... H01R 13/639

[52] U.S. Cl. ..... 439/347; 439/607

[58] Field of Search ..... 339/91 R, 143 R

[56] References Cited

U.S. PATENT DOCUMENTS

| | | | |
|---|---|---|---|
| 3,566,336 | 2/1971 | Johnson et al. | 339/143 R |
| 3,824,525 | 7/1974 | Keller | 339/91 R |
| 4,512,618 | 4/1986 | Kumar | 339/143 R |
| 4,556,270 | 12/1985 | Schutzle et al. | 339/91 R |
| 4,585,292 | 4/1986 | Frantz et al. | 339/143 R |

*Primary Examiner*—John McQuade

*Attorney, Agent, or Firm*—Silverman, Cass, Singer & Winburn, Ltd.

[57] ABSTRACT

A connector is provided with lock means for locking a plug connector and a receptacle connector constituting the connector, which lock means includes a holding aperture having insert slot formed in locking ear located at each end of the plug connector and a locking member having a loop lock portion larger than the holding aperture and secured to a mounting lug at each end of a shield of the receptacle connector. The lock means comprises upstanding brackets being integrally formed with a mounting ear of each end of the shield, each the upstanding bracket having an insert aperture in opposition to that of the mating upstanding bracket for a mounting leg of the locking member and upper corners, on both sides of the insert aperture, being bent to oppose to similarly bent upper corners of the mating upstanding bracket to form a V-shaped recess.

8 Claims, 21 Drawing Figures

FIG. 9a
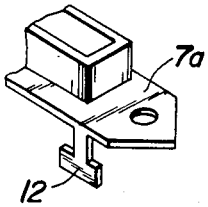
FIG. 9b
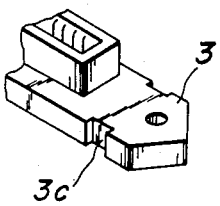
FIG. 9c
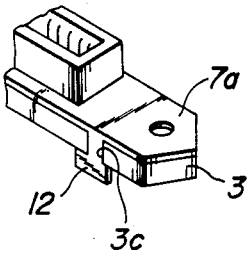
FIG. 10a
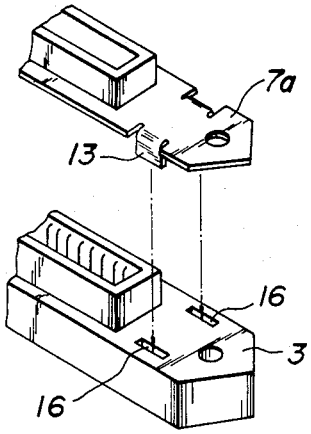
FIG. 10b

CONNECTOR HAVING LOCK MEANS

BACKGROUND OF THE INVENTION

This invention relates to an electric connector having lock means, and more particularly locking structure for connector.

In connecting circuits of electronic devices with each other, for example, a receptacle connector connected with one circuit is fixed to a panel of a device, and a plug connector connected with the other circuit is then inserted into the receptacle connector to complete the connection of the two circuits. In this case, it is required to prevent the plug connector from being removed to open the connection due to tensile forces acting upon a cable connected to the plug connector. For this purpose, for example, locking members 1 each consisting of a loop lock portion 1*a*, support legs 1*b* and mounting legs 1*c* are secured reciprocatively movable in directions shown by an arrow to mounting lugs 3 on both sides of a receptacle connector 2 as shown in FIG. 1*a*, while locking ears 5 each including a holding aperture 5*b* having insert slot 5*a* are provided on both ends of a plug connector 4 as shown in FIG. 1*b*. After connection of the receptacle connector 2 and the plug connector 4, the locking members 1 are pushed into the holding apertures 5*b* so as to urge the support legs 1*b* toward each other to complete the locking of the connector.

In this case, journal portions 6*a* of a support plate 6 are formed so as to surround the mounting legs 1*c* of the locking member as shown in FIG. 1*a*. The journal portions 6*a* are formed with V-shaped recesses 6*b*, respectively, as shown in FIGS. 2*a* and 2*b*. The mounting legs 1*c* tending to expand away from each other are fitted in the recesses 6*b* to maintain the locking position of the locking member with the aid of the resilience of the locking member 1. Moreover, in order to avoid decreasing the number of the connectors due to increase in height of the connectors in packages for shipment, the support legs 1*b* are turned to horizontal positions so as to assume at edges 6*c* of the journal portions 6*a* other than the V-shaped recesses 6*b*, so that the locking members 1 are kept in the horizontal position with the aid of the spring forces of the support legs 1*b* tending to expand away from each other.

In the prior art, however, the following method has been employed in order to rotatably secure the mouning legs 1*c* of the locking member 1 into both the lugs 3. As shown in FIG. 3 (refer to FIG. 1*a*), a support plate 6 having journal portions 6*a* is formed with a mounting aperture 6*d* and positioning jaws 6*e* formed by bending two corners of the plate. The support plates 6 are fixed to the mounting lugs 3 of the receptacle 2 by means of plugs 8 together with mounting ears 7*a* of a metal shield 7 covering parts 2*a* of the receptacle connector 2.

With this arrangement, the number of parts of this connector is increased to make difficult the manufacturing and assembling thereof. In order to ensure the complete locking, moreover, the mounting legs 1*c* of the locking members 1 must be supported by the journal portions 6*a* so as not to twist the mounting legs 1*c* and at the same time, the locking members 1 must be kept perpendicular to the support plates 6 by means of the V-shaped recesses 6*b*. For these purposes, it is needed to form centers of the journal portions 6*a* cylindrically rolled, and the V-shaped recesses 6*b* being aligned with each other. At the same time, moreover, it is necessary to roll the journal portions 6*a* so as to locate the V-shaped recesses 6*b* at the uppermost positions of the journal portions 6*a*. The above facts make difficult the manufacturing of the connector and increase the manufacturing cost in conjunction with the increased number of the parts.

SUMMARY OF THE INVENTION

It is a principal object of the invention to provide a connector having lock means which eliminates all the disadvantages of the prior art and which includes less number of parts without requiring throublesome operation for forming journal portions for locking members, thereby decreasing the manufacturing cost of the connector.

In order to achieve this object, in a connector having lock means for locking a plug connector and a receptacle connector constituting the connector, said lock means including a holding aperture having insert slot formed in locking ear located at each end of the plug connector and a locking member having a loop lock portion larger than said holding aperture and secured to a mounting lug at each end of a shield of said receptacle connector, according to the invention said lock means comprises upstanding brackets being integrally formed with a mounting ear of each end of said shield, each said upstanding bracket having an insert aperture in opposition to that of the mating upstanding bracket for a mounting leg of said locking member and upper corners, on both sides of said insert aperture, being bent to oppose to similarly bent upper corners of the mating upstanding bracket to form a V-shaped recess.

The invention will be more fully understood by referring to the following detailed specification and claims taken in connection with the appended drawings.

BRIEF DESCRIPTION OF THE DRAWINGS

FIGS. 9*a*, 9*b* and 9*c* are perspective views illustrating another embodiment of fixing means shown in FIG. 8;

FIGS. 10*a* and 10*b* are partial perspective views illustrating a further embodiment of fixing means;

DESCRIPTION OF THE PREFERRED EMBODIMENTS

Figure 4A:
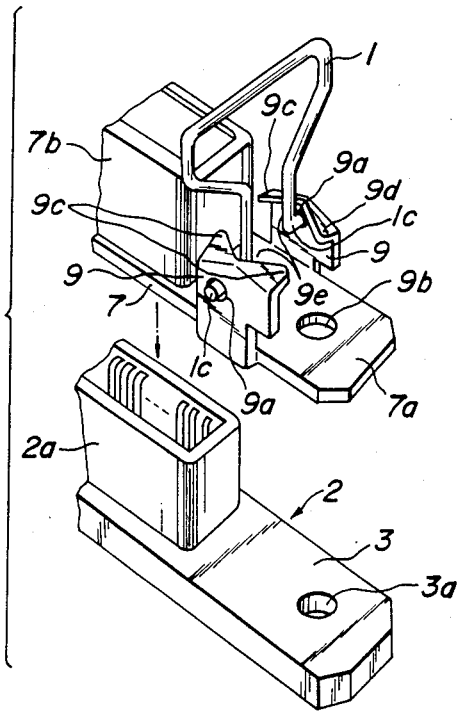
FIG. 4*a* is a partial exploded perspective view of a connector of one embodiment of the invention.
Figure 4B:
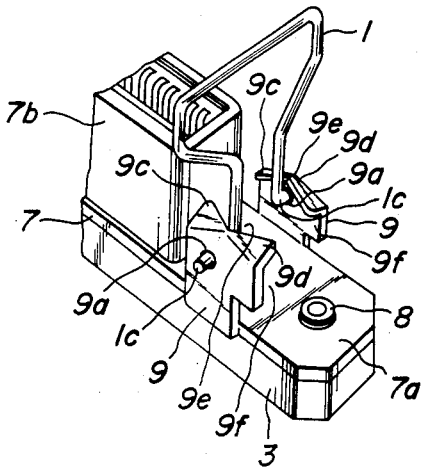
FIG. 4*b* is a partial perspective view of the connector shown in FIG. 4*a;*
Figure 4C:
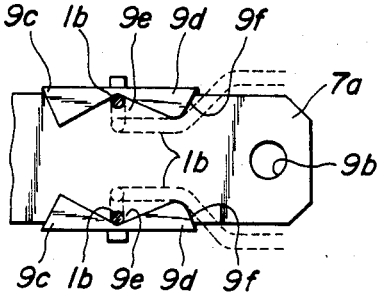
FIG. 4*c* is a partial plan view of the connector shown in FIG. 4*a;*

FIGS. 4*a*, 4*b* and 4*c* illustrate one embodiment of the invention. According to the invention, as shown in FIG. 4*a* each mounting ear 7*a* of a shield 7 is integrally formed on both sides with upstanding brackets 9 by punching and bending the mounting ear 7*a* for supporting a locking member 1 without using a support plate 6 separately manufactured as in FIG. 1*a*. Each the upstanding bracket 9 is formed with an insert aperture 9*a* for the mounting leg 1*c* of the locking member 1. In this case, the insert aperture 9*a*, is shifted to a shield shell 7*b*. The mounting ear 7*a* is formed with a fixing aperture 9*b* adapted to be aligned with a support aperture 3*a* of each mounting lug 3. After the shield 7 has been fitted in a receptacle connector, the receptacle connector is fixed to a panel by means of a plug 8 to form a unitary body for example as shown in FIG. 4.

Figures 1A, 1B:
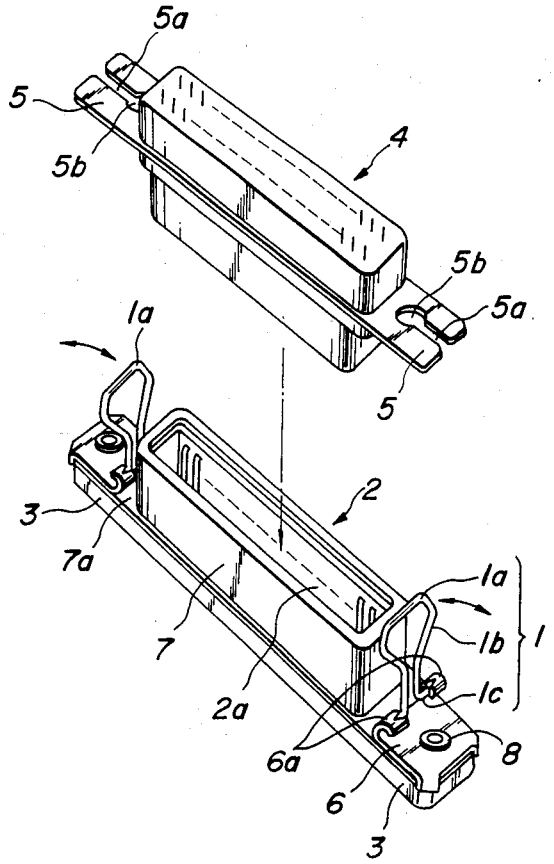
FIG. 1b PRIOR ART
FIG. 1a PRIOR ART
FIGS. 1*a* and 1*b* are perspective views of a connector of the prior art.
Figure 2A:
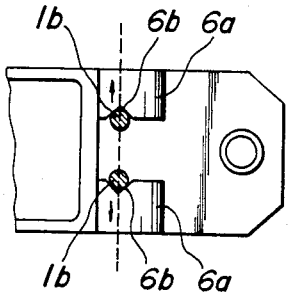
FIG 2a PRIOR ART
FIGS. 2*a* and 2*b* are partial plan views of the connector shown in FIGS. 1*a* and 1*b;*
Figure 2B:
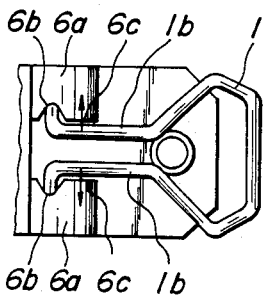
FIG 2b PRIOR ART

According to the invention, moreover, upper triangular corners 9*c* and 9*d* of the opposed brackets 9 are bent in the proximity of the insert apertures 9*a* toward each other to form V-shaped recesses 9*e* as clearly shown in plan view of FIG. 4*c* corresponding to the V-shaped recesses 6*d* in FIG. 1*a*. When support legs 1*b* of the locking member 1 are inserted in the V-shaped recesses 9*e*, the locking member 1 is kept upstanding as that of the prior art. Furthermore, when the locking member 1 is turned to a horizontal portion as shown in broken lines in FIG. 4*c*, the support legs 1*b* are maintained by outer edges 9*f* of the corners 9*c* and 9*d*, thereby simplifying the manufacturing of the connector in comparison with the prior art.

Figure 5A:
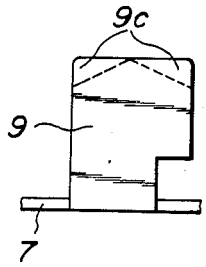
FIG. 5*a* illustrates a upstanding bracket used in the connector according to the invention before bending its corners.
Figure 5B:
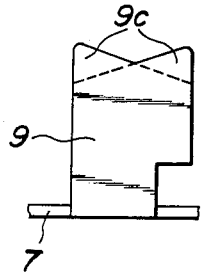
FIG. 5*b* illustrates a modification of the upstanding bracket shown in FIG. 5*a;*

In bending the corners of the upstanding bracket 9, the substantially rectangular bracket 9 having a flat horizontal upper edge is bent along broken lines in FIG. 5*a*. However, it may be particularly shaped as shown in FIG. 5*b* and bent along broken lines. The bracket 9 shown in FIG. 5*a* can be worked easier than that shown in FIG. 5*b*.

As above described, according to the invention, the upstanding brackets 9 for the locking members 1 are formed integrally with mounting ears of the shield 7 to form a unitary body in conjunction with the receptacle connector 2, thereby eliminating the support plate 6 having journal portions 6*a* for the locking member 1 to be fixed to the receptacle connector 2 together with the shield 7. Accordingly, the number of parts is decreased and manufacturing and assembling of the connector is made easy. In addition thereto, according to the invention, the V-shaped recesses 9*e* for maintaining the locking member upstanding can be formed only by bending the corners 9*c* and 9*d* toward each other without requiring troublesome operation for forming journal portions 6*a* having V-shaped recesses 6*b* located at the uppermost of the journal portions 6*a* and in alignment with centers of the journal portions 6*a*. As the result, the manufacturing of the connector is made easy to decrease the manufacturing cost in conjunction with the decrease of the number of the parts.

Figure 3:
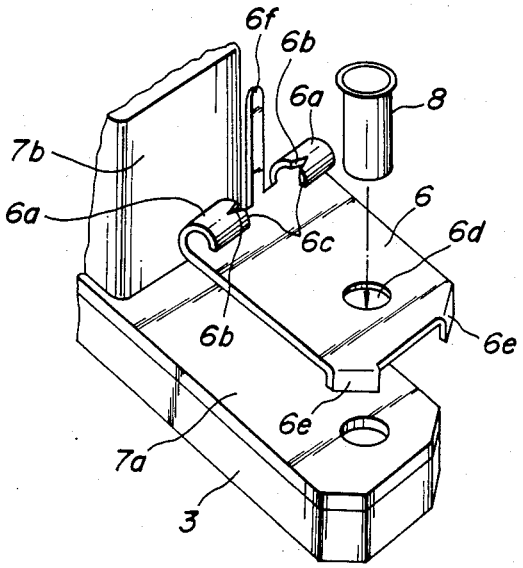
FIG 3 PRIOR ART
FIG. 3 is a partial perspective view of the connector shown in FIGS. 1*a* and 1*b;*
Figure 6:
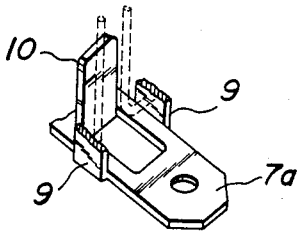
FIG. 6 is a partial perspective view of another embodiment of the invention having a position control plate.
Figure 7:
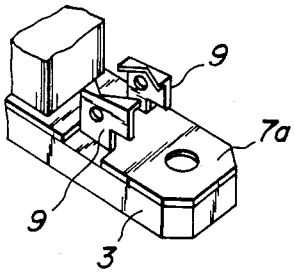
FIG. 7 is a partial perspective view of a further embodiment of the invention.

Referring back to FIG. 3, in the prior art, the support plate 6 is formed with a position control plate 6*f* formed by cutting a blank material of the support plate 6 behind the shield shell 7*b*, so that the support leg 1*b* of the locking member 1 abuts against the position control plate 6*f*. In this manner, support legs 1*b* are prevented from coming out of the V-shaped recesses 6*b* onto a side of the shield shell 7*b*. Such a removal of the support legs 1*b* from the V-shaped recesses 6*b* would cause the locking member 1 to lean over a socket of the plug connector of the receptacle connector so as to obstruct the insertion of the plug connector. In order to assure such a prevention according to one embodiment of the present invention, a part of the mounting ear 7*a* is cut and raised to form a position control plate 10 as shown in FIG. 6. As shown in FIG. 7, moreover, parts of the mounting ear 7*a* may be cut and raised to form upstanding brackets 9 so as to narrow the distance between the upstanding brackets 9 as shown in FIG. 7, thereby preventing the mounting legs 1*c* supported in insert apertures 9*a* of the brackets 9 from extending outwardly beyond the mounting ears 7*a*.

Figure 8:
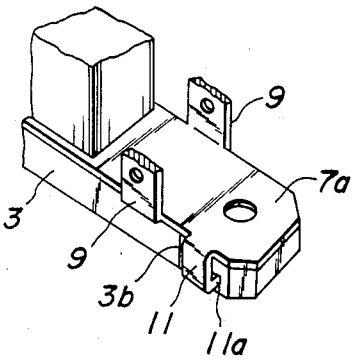
FIG. 8 is a partial perspective view of a further embodiment of the invention illustrating fixing means for a mounting ear.
Figure 11A:
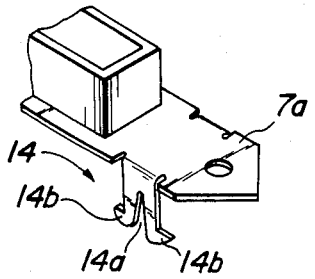
FIGS. 11*a* and 11*b* are partial perspective views illustrating a modification of fixing means according to the invention.
Figure 11B:
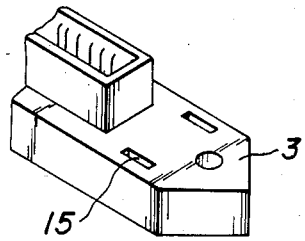

Instead of the plug 8 shown in FIG. 4*b*, a mounting ear 7*a* may be formed on both sides with fixing jaws 11 which are fitted in fixing grooves 3*b* formed in both sides of the mounting lug 3 and distal ends 11*a* of the fixing jaws 11 are bent inwardly on an underside of the mounting lug 3, thereby fixing the mounting ear 7*a* to the mounting lug as shown in FIG. 8. The mounting ear 7*a* may be integrally provided with T-shaped fixing jaws 12 which may extend into fixing grooves 3*c* of the mounting lug 3 so as to be fitted therein as shown in FIGS. 9*a*, 9*b* and 9*c* and may be bent inwardly to fix the mounting ear to the mounting lug. As an alternative, a mounting ear 7*a* may be formed on both sides with fixing jaws 13, a distance between which is less than a width of the mounting ear 7*a*, which are press-fitted into fixing slits 16 of the mounting lug 3 to fix the mounting ear 7*a* to the mounting lug 3 as shown in FIGS. 10*a* and 10*b*. Moreover, a mounting ear 7*a* may be formed on both sides with fixing jaws 14 each having a slit 14*a* and pawls 14*b* on both sides thereof. These fixing jaws 14 are forced into fixing slits 15 to close the pawls, so that after the pawls 14*b* have passed through the slits 15, the pawls 14*b* engage an underside of the mounting lug 3 as shown in FIGS. 11*a* and 11*b*.

Figure 12:
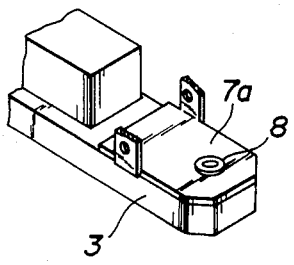
FIG. 12 is a partial perspective view of a modification of the connector according to the invention.

In the event that the shield 7 is not needed, a mounting ear 7*a* may be formed only with necessary parts for supporting the locking member 1 and fixed to the mounting lug 3 by means of a plug 8 as shown in FIG. 12.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A connector having lock means for locking a plug connector and a receptacle connector constituting the connector, said lock means including a holding aperture having an insert slot formed in a locking ear located at each end of the plug connector and a locking member having a loop lock portion larger than said holding aperture and secured to a mounting lug at each end of said receptacle connector, said lock means comprising upstanding brackets being integrally formed with a mounting ear at each end of a shield fitted around said receptacle connector, each said upstanding bracket having an insert aperture in opposition to that of the mating upstanding bracket for a mounting leg of said locking member and upper corners, on both sides of said insert aperture, being bent to oppose to similarly bent upper corners of the mating upstanding bracket to form a V-shaped recess.

2. A connector as set forth in claim 1, wherein each said upstanding bracket is formed to have a flat horizontal upper edge and its corners are bent into triangular shapes to form said V-shaped recess.

3. A connector as set forth in claim 1, wherein said mounting ear of each end of said shield is cut and raised to form a position control plate for preventing said locking member from obstructing an insertion of said plug connector into said receptacle connector.

4. A connector as set forth in claim 1, wherein said upstanding brackets are formed, a distance between them being less than a width of each said mounting ear of the shield.

5. A connector as set forth in claim 1, wherein each said mounting ear is integrally formed on both sides with fixing jaws which are fitted in fixing grooves formed in both sides of each said mounting lug and distal ends of said fixing jaws are bent inwardly on an underside of the mounting lug to fix the mounting ears to the mounting lugs.

6. A connector as set forth in claim 5, wherein said fixing jaws are formed in T-shape.

7. A connector as set forth in claim 1, wherein each said mounting ear is integrally formed on both sides with fixing jaws, a distance between them being less than a width of each said mounting ear of the shield, and the fixing jaws are press-fitted into fixing slits formed in each said mounting lug to fix the mounting ears to the mounting lugs.

8. A connector as set forth in claim 1, wherein each said mounting ear is integrally formed on both sides with fixing jaws each having a slit and pawls on both sides thereof, such that after the fixing jaws have passed through fixing slits formed in said mounting lugs, said pawls engage an underside of the mounting lugs to fix the mounting ears to the mounting lugs.

* * * * *